US006739464B1

(12) United States Patent
Manyek

(10) Patent No.: US 6,739,464 B1
(45) Date of Patent: May 25, 2004

(54) GLIDE ELEMENT FOR A TELESCOPING UNCOUPLING LEVER

(75) Inventor: Peter R. Manyek, Highland, IN (US)

(73) Assignee: Stanrail Corporation, Gary, IN (US)

( * ) Notice: Subject to any disclaimer, the term of this patent is extended or adjusted under 35 U.S.C. 154(b) by 0 days.

(21) Appl. No.: 10/431,405

(22) Filed: May 7, 2003

(51) Int. Cl.[7] ..... B61G 3/00

(52) U.S. Cl. ..... 213/159; 213/162; 213/163; 213/166; 213/219

(58) Field of Search ..... 213/159, 162, 213/211, 163, 166, 219; 384/42, 26, 39

(56) References Cited

U.S. PATENT DOCUMENTS

| | | | | | |
|---|---|---|---|---|---|
| 3,933,252 | A | * | 1/1976 | Murphy et al. | 213/166 |
| 4,010,854 | A | * | 3/1977 | Manyek | 213/166 |
| 4,378,890 | A | | 4/1983 | Empson | |
| 4,460,099 | A | | 7/1984 | Empson | |
| 4,602,717 | A | | 7/1986 | Krzanowsky | |
| RE33,667 | E | | 8/1991 | Chierici | |
| 5,501,526 | A | * | 3/1996 | Asai et al. | 384/13 |

* cited by examiner

*Primary Examiner*—Mark T. Le

(74) *Attorney, Agent, or Firm*—Cook, Alex, McFarron, Manzo, Cummings & Mehler, Ltd.

(57) ABSTRACT

An elongated tubular glide housing for a telescoping, uncoupling lever for a railroad car. A tubular glide housing includes a rectangular seal enclosure having a top wall, a bottom wall, an outwardly located side wall, and an inwardly located side wall defining a passage extending through the enclosure. The top and bottom walls of the enclosure have leading and trailing edges. A circular tool opening is formed in each of the outwardly and inwardly located side walls. A pair of elongated plastic glide elements are positioned in the passage extending through the rectangular steel enclosure. Each of the elongated plastic glide elements is formed with a generally L-shaped transverse cross-section including a first leg and a second leg. The L-shaped elements are dimensioned to fit into the passage of the steel enclosure. Each of the first and second legs have a leading edge and a trailing edge. An outwardly projecting retaining tab is formed at each of the leading and trailing edges of the first leg. A cylindrical boss is formed integrally with the second leg of each glide element and extends outwardly therefrom. The glide elements are positioned in the passage with each glide element having a second leg located against one of the side walls with its boss seated in the tool passage and the first leg positioned adjacent one of either the top or bottom walls with the retaining tabs of the first leg engaging the leading and trailing edges of the top and bottom walls of the rectangular enclosure.

2 Claims, 3 Drawing Sheets

GLIDE ELEMENT FOR A TELESCOPING UNCOUPLING LEVER

BACKGROUND AND SUMMARY OF THE INVENTION

This invention relates to a tubular glide housing and glide elements for a telescoping uncoupling lever of the type used on railroad cars. Uncoupling levers having L-shaped glide members of the type shown and described in U.S. Pat. No. 4,602,717 are installed on many railroad cars now in service. Upon breakage of one or more of the flexible hooks on such a glide member, the glide member may fall out of the glide housing. It is then necessary to replace the glide element which requires disassembly of the telescoping uncoupling lever in the field which may result in extended down time for a railroad car.

An object of this invention is a tubular glide housing of a telescoping uncoupling lever having glide elements which resist displacement from their glide housing even when parts thereof are damaged or worn down to the point that the lever members do not keep glide elements in place.

Another object of this invention is a glide element which is formed so that the edges of the glide element are out of contact with lever stops during operation of the uncoupling lever.

An additional object of this invention is a glide element having an integral anchoring boss which assists in maintaining the glide element in a glide housing and in its correct position.

Other objects of the invention will be found in the following specification, drawings and claims.

BRIEF DESCRIPTION OF THE DRAWINGS

The invention is shown more or less diagrammatically in the following drawings wherein.

DESCRIPTION OF THE PREFERRED EMBODIMENT

Figure 2:
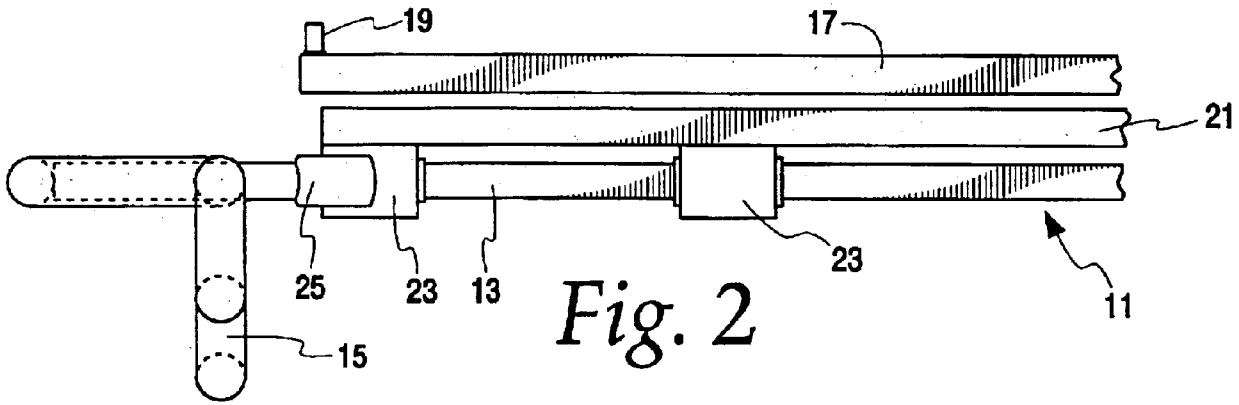
FIG. 2 is a partial top view of the telescoping uncoupling lever of FIG. 1.
Figure 1:
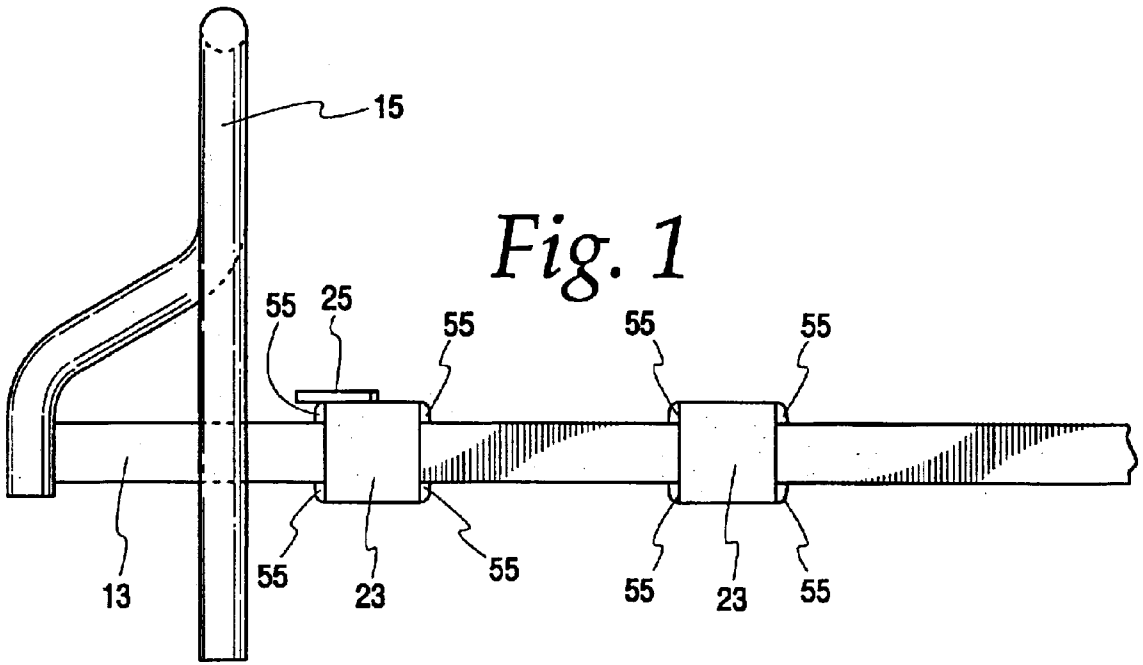
FIG. 1 is a partial front elevational view of a telescoping uncoupling lever for a railroad car.
Figure 6:
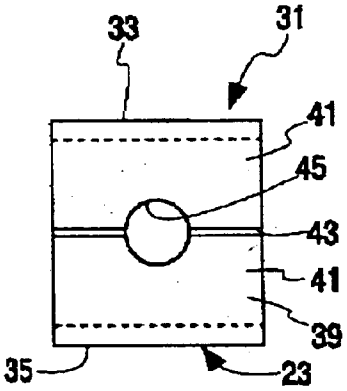
FIG. 6 is a side elevational view of the tubular glide housing of FIG. 4.
Figure 5:
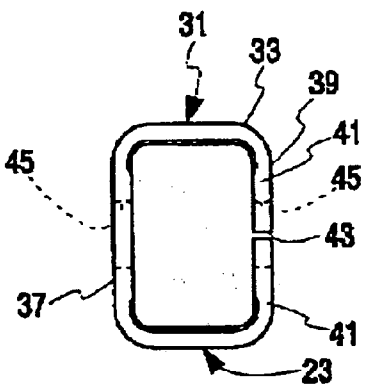
FIG. 5 is an end view of the tubular glide housing of FIG. 4.
Figure 4:
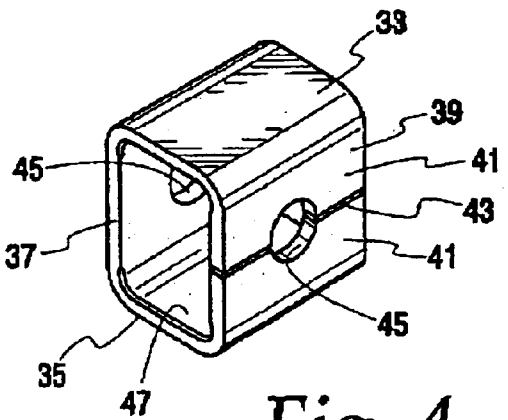
FIG. 4 is an isometric view of a tubular glide housing of this invention.

FIGS. 1 and 2 of the drawings are partial views of a conventional railroad car telescoping uncoupling lever 11. This lever includes a first lever member 13 which is welded to a handle 15. A second lever member 17 connects to an uncoupler lock lifter which is not shown. An outwardly extending stop pin 19 is located at the end of the second lever member opposite to the lock lifter. The first and second lever members 13 and 17, which are rectangular in transverse cross-section, are connected to a central lever member 21 which is a solid rectangular steel bar or a hollow rectangular steel tube. These connections are afforded through tubular glide housings or sleeves 23. A stop plate 25 is attached to one of the end tubular glide housings 23 to engage the handle 15 as is shown most clearly in FIGS. 1 and 2 of the drawings and a second stop plate, which is not shown, is attached to another end tubular glide to engage the lock lifter.

Referring now to FIGS. 3–6 of the drawings, a tubular glide housing 23 embodying the novel aspects of this invention is formed as a rectangular enclosure 31 of steel bent to form a top wall 33, a bottom wall 35, an outwardly located side wall 37 and an inside wall 39. The top and bottom walls have leading and trailing edges. The inside wall 39 is formed of flanges 41 which are welded to the central lever member 21. The flanges 41 are spaced apart a small distance to form a narrow longitudinally extending slot 43. Circular tool passages 45 are formed in the outwardly located side wall 37 and the inside wall 39. The circular tool passages are defined by annular seating surfaces. The rectangular enclosure 31 defines a rectangular passage 47 which receives one of the lever members, in this example, the first lever member 13.

Figure 3:
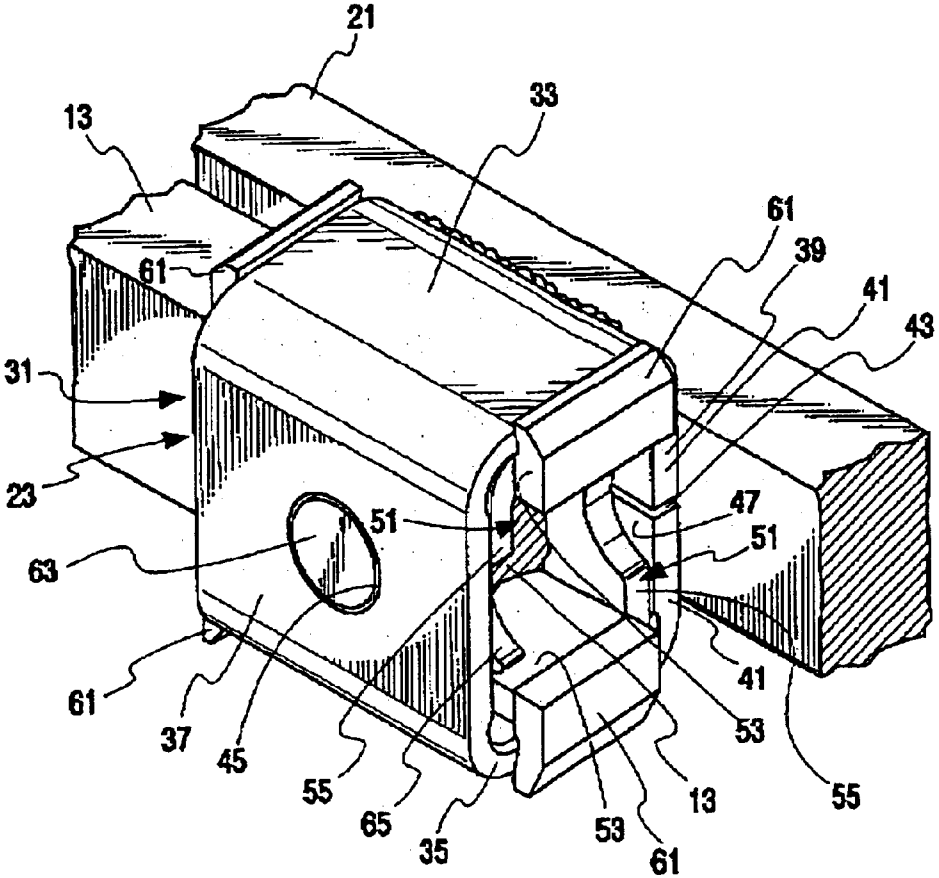
FIG. 3 is a partial isometric view of a tubular glide housing with portions of some parts broken away and showing the glide elements of this invention installed in the tubular glide housing.
Figure 9:
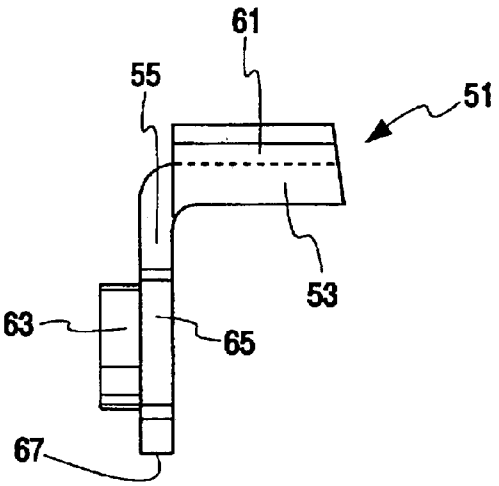
FIG. 9 is a front elevational view of the glide element of FIG. 7.
Figure 8:
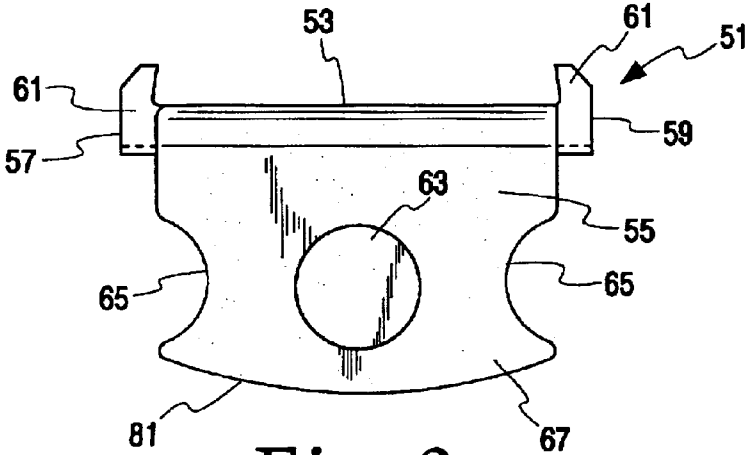
FIG. 8 is a side elevational view of the glide element of FIG. 7.
Figure 7:
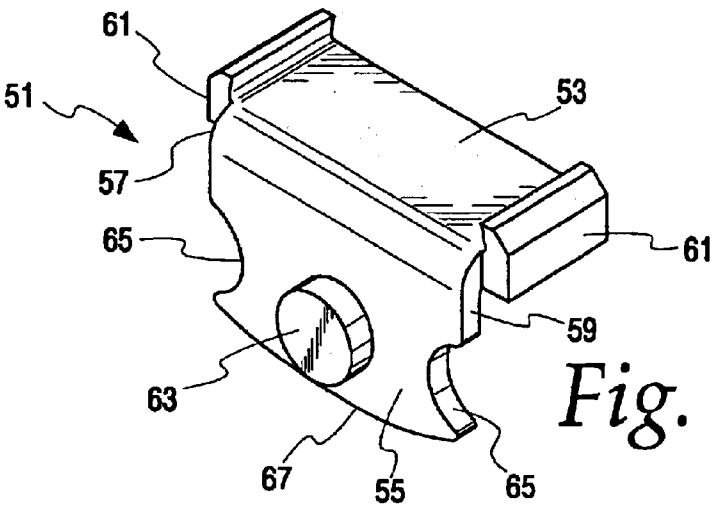
FIG. 7 is an isometric view of the glide element of this invention.

FIG. 3 of the drawings shows a pair of L-shaped glide members 51 of the invention positioned in the rectangular passage 47 around the first lever member 13 which is shown partially broken away. As depicted in FIGS. 7, 8, and 9 of the drawings, the glide element 51 is formed with a L-shaped transverse cross-section having a first leg 53 and a second leg 55 extending at a right angle to the first leg. Each of the legs is formed with opposite ends 57 and 59. An upstanding retaining tab 61 is formed integrally at each of the opposite ends 57 and 59 of the first leg 53. A cylindrical boss 63 is formed integrally with the second leg 55 and extends laterally outwardly of the glide element. A semi-circular notch 65 is formed in each of the leading and trailing edges of the leg 55. The leg 55 has a curved bottom edge 67 to facilitate installation of the glide member 51 into the tubular glide housings. The glide elements 51 are preferably formed of a high density polyethylene plastic or other appropriate material.

A pair of L-shaped glide elements 51 are installed in the rectangular passage 47 of a tubular glide housing 53 in the manner shown in FIG. 3 of the drawings with one glide element inverted relative to the other to form a box-like structure around a lever member such as the first lever member 13 which is shown partially broken away in the drawing. One glide element 51 is installed with its first leg 53 positioned against the inside surface of the top wall 33 of the tubular glide housing 23 and its second leg 55 positioned against the side wall 37 of the tubular glide housing by snapping the glide element into place. The boss 63 of the second leg is seated in the circular tool passage 45 of the side wall 37. The upstanding retaining tabs 61 of the first leg engage the leading and trailing edges of the top wall 33 of the tubular glide housing. The notches 65 in the second leg face the open longitudinal ends of the tubular glide housing to reduce the possibility that the glide element will be struck and broken by an end of a stop 19 of the type shown at the end of the second lever member 17.

Another glide element 51 is installed in the tubular glide housing 23 inverted relative to the other glide element. The inverted glide element is positioned with its second leg 55 located against the inner surface of the inside wall 39 of the tubular glide housing 23, and its first leg positioned against the inner surface of the bottom wall 35 of the tubular glide housing by snapping the glide element into place. The upstanding retaining tabs 61 engage the leading and trailing edges of the bottom wall 35. The boss 63 of the second leg 55 will seat in the circular tool passage 45 of the inside wall 39 of the tubular glide housing, but this is not visible in FIG. 3 of the drawings. A notch 65 with the second leg 55 aligns with a respective notch of the other glide element as is shown in FIG. 3 of the drawings.

The tubular glide housing 23 and glide elements 51 of this invention are designed to reduce the possibility of the glide elements being damaged and dislocated from their glide housing where they provide bearing and glide surfaces for the lever arms 13 and 17. The notches 65 formed in the leading and trailing edges of the second leg 55 of each glide element reduce the possibility of damage to a glide element by contact with a stop pin such as pin 19 since the notches place the trailing and leading end surfaces of the glide element inside the rectangular closure 31 of a tubular glide housing 23. The integral boss 63 formed on the exterior of the second leg 55 seats in a circular tool passage 45 of the tubular glide housing to help retain the glide element in the tubular glide housing even in the event that one or both of the upstanding retaining tabs 61 of the first leg 53 are broken away. The boss 63 also ensures that glide elements 51 are kept in place even when worn down to the extent that lever members 13 or 17 do not maintain the glide elements 51 in place. The construction of the tubular glide housing 23 of this invention provides a circular tool passage 45 formed in the inside wall 39 with an annular seating surface for the boss 63 which annular surface is almost equivalent to the annular seating surface provided by the tool passage 45 formed in the outside wall 37 of the tubular glide housing. This is accomplished by extending the flanges 41 of the rectangular enclosure 31 of the tubular glide housing to provide only a narrow slot 43 between the opposed edges of the flanges in contrast to the tubular glide housings of the prior art in which the opposite edges of the flanges forming the inside wall were spaced a considerable distance apart; and thus were unable to provide a almost complete annual seating surface in the tool opening to engage a boss. The provision of a boss 63 for each glide element acts to maintain the glide element in the glide housing even in situations when both of the retaining tabs 61 have been broken away. It is believed that the provision of bosses for the glide elements increases the holding power of the glide elements in the glide housing by several magnitudes in comparison to the holding power of the retaining tabs alone.

I claim:

1. An elongated tubular glide housing for a telescoping, uncoupling lever for a railroad car, said tubular glide housing including:

a rectangular seal enclosure having a top wall, a bottom wall, an outwardly located side wall and an inwardly located side wall defining a passage extending through said enclosure, said top and bottom walls each have a leading and trailing edges, a circular tool opening formed at each of said outwardly and inwardly located side walls, a pair of elongated, plastic glide elements positioned in said passage extending through said rectangular steel enclosure, each elongated, plastic glide element being of generally L-shaped transverse cross-section and including a first leg and a second leg with said element dimension to fit into said passage, each of said first and second legs having a leading edge and a trailing edge, an outwardly projecting retaining tab formed at said leading and trailing edges of said first leg, and a cylindrical boss formed integrally with said second leg and extending outwardly therefrom, said glide elements positioned in said passage with each glide element having said second leg positioned against one of said side walls with said boss seated in said tool opening and said first leg positioned adjacent one of said top and bottom walls with said retaining tabs engaging said leading and trailing edges of said rectangular enclosure.

2. The elongated tubular glide housing of claim 1 in which said leading and said trailing edges of said second legs of said elongated plastic glide elements are formed with semicircular notches.

* * * * *